US011318753B2

(12) United States Patent
Kikuchi

(10) Patent No.: US 11,318,753 B2
(45) Date of Patent: May 3, 2022

(54) CONTROL DEVICE AND CONTROL METHOD

(71) Applicant: CANON KABUSHIKI KAISHA, Tokyo (JP)

(72) Inventor: Takashi Kikuchi, Kawasaki (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 16/941,882

(22) Filed: Jul. 29, 2020

(65) Prior Publication Data

US 2021/0039398 A1 Feb. 11, 2021

(30) Foreign Application Priority Data

Aug. 9, 2019 (JP) ..... JP2019-147685

(51) Int. Cl.
*B41J 2/175* (2006.01)
*B41J 2/165* (2006.01)

(52) U.S. Cl.
CPC .. *B41J 2/17566* (2013.01); *B41J 2002/17569* (2013.01)

(58) Field of Classification Search
CPC ..... B41J 2/0451; B41J 2/165; B41J 2/16579; B41J 2/17566; B41J 2002/16502
See application file for complete search history.

(56) References Cited

U.S. PATENT DOCUMENTS

| | | | | |
|---|---|---|---|---|
| 6,960,259 | B2 | 11/2005 | Takekoshi et al. | |
| 7,104,216 | B2 | 9/2006 | Suzuki et al. | |
| 7,211,151 | B2 | 5/2007 | Takekoshi et al. | |
| 8,456,682 | B2 | 6/2013 | Yamakawa et al. | |
| 2010/0245436 | A1* | 9/2010 | Nishida | B41J 29/38 347/14 |
| 2011/0007359 | A1 | 1/2011 | Yamakawa et al. | |
| 2015/0054881 | A1* | 2/2015 | Tanaka | B41J 29/38 347/19 |
| 2017/0190186 | A1* | 7/2017 | Kubota | B41J 2/17503 |
| 2018/0022112 | A1* | 1/2018 | Billow | B41J 2/0458 347/47 |

FOREIGN PATENT DOCUMENTS

| | | | |
|---|---|---|---|
| JP | 2009-282947 | A | 12/2009 |
| JP | 5043762 | B2 | 10/2012 |

* cited by examiner

*Primary Examiner* — Jason S Uhlenhake
(74) *Attorney, Agent, or Firm* — Venable LLP

(57) ABSTRACT

To provide a control device and a control method with which a consumed amount of ink can be calculated with higher accuracy, a processing unit configured to execute image processing to image data, based on a reference value according to a state of a print head of a printing apparatus, and a calculating unit configured to calculate a consumed amount of ink during printing, based on print data and a parameter indicating a condition of printing, the print data being generated based on the image data to which the image processing has been performed by the processing unit, are included.

18 Claims, 9 Drawing Sheets

PRINT PARAMETERS RELATED TO THE CONSUMED AMOUNT OF INK

| DATE | PAPER TYPE | PRINT DATA | NUMBER OF SHEETS | NUMBER OF PRINTS | NUMBER OF COLORS | RESOLUTION | REMAINING AMOUNT OF INK | EJECTION AMOUNT OF INK A | EJECTION AMOUNT OF INK B | ... |
|---|---|---|---|---|---|---|---|---|---|---|
| yyyy/mm/dd | Paper 1 | xxx.pdf | xx page | x copies | x color | xx dpi | xxx mL | x1 | x2 | |
| yyyy/mm/dd | Paper 1 | xxx.pdf | xx page | x copies | y color | yy dpi | yyy mL | y1 | y2 | |
| yyyy/mm/dd | Paper 1 | xxx.pdf | xx page | x copies | z color | xx dpi | zzz mL | z1 | z2 | |

FIG.6

CONTROL DEVICE AND CONTROL METHOD

BACKGROUND OF THE INVENTION

Field of the Invention

The present disclosure relates to a control device and a control method capable of executing image processing on image data.

Description of the Related Art

The consumed amount of a printing material such as ink is an important index for cost management of printing apparatuses. Therefore, it is desired that the consumed amount of such a printing material is calculated with higher accuracy. Japanese Patent No. 5043762 discloses a technology for accurately calculating the consumed amount of a printing material. Specifically, for variable printing, fixed information and variable information are rasterized into image data, respectively, and the consumed amount of a printing material is calculated based on the image data.

SUMMARY OF THE INVENTION

Note that, in an ink-jet printing apparatus that performs printing by ejecting ink as a printing material, the ejection state of ink from a print head varies between apparatuses due to manufacturing tolerances, etc., and the ejection state changes from normal use. Therefore, the process of detecting the ejection state of ink from a print head is performed.

The present disclosure has been made in view of the above problems, so as to provide a technology with which the consumed amount of ink can be calculated more accurately.

In the first aspect of the present invention, there is provided a control device comprising:

a processing unit configured to perform image processing to image data, based on a reference value according to a state of a print head of a printing apparatus; and a calculating unit configured to calculate a consumed amount of ink, based on print data and a parameter indicating a condition of printing, the print data being generated based on the image data that has been processed by the processing unit.

In the second aspect of the present invention, there is provided a control method of a control device, the control method comprising:

performing image processing to image data, based on a reference value according to a state of a print head of a printing apparatus; and calculating a consumed amount of ink, based on print data and a parameter indicating a condition of printing, the print data being generated based on the image data that has been processed by the processing unit.

According to the present disclosure, it is possible to calculate the consumed amount of ink more accurately.

Further features of the present invention will become apparent from the following description of exemplary embodiments with reference to the attached drawings.

BRIEF DESCRIPTION OF THE DRAWINGS

FIG. 5 is a diagram showing a relation between FIGS. 5A and 5B;

FIG. 6 is a diagram illustrating an example of a form of displaying the consumed amounts and remaining amounts of ink;

DESCRIPTION OF THE EMBODIMENTS

Hereinafter, a detailed explanation is given of the control device and the control method according to the present embodiment with reference to the drawings. Note that the explanation below is not intended to limit the present embodiment, and every combination of the characteristics explained below is not essential to the solution means of the present embodiment. Further, the relative positions, shapes, and the like of the constituent elements described in the present embodiment are merely examples and are not intended to limit the range of the present embodiment to those examples.

(Device Configuration)

Figure 1:
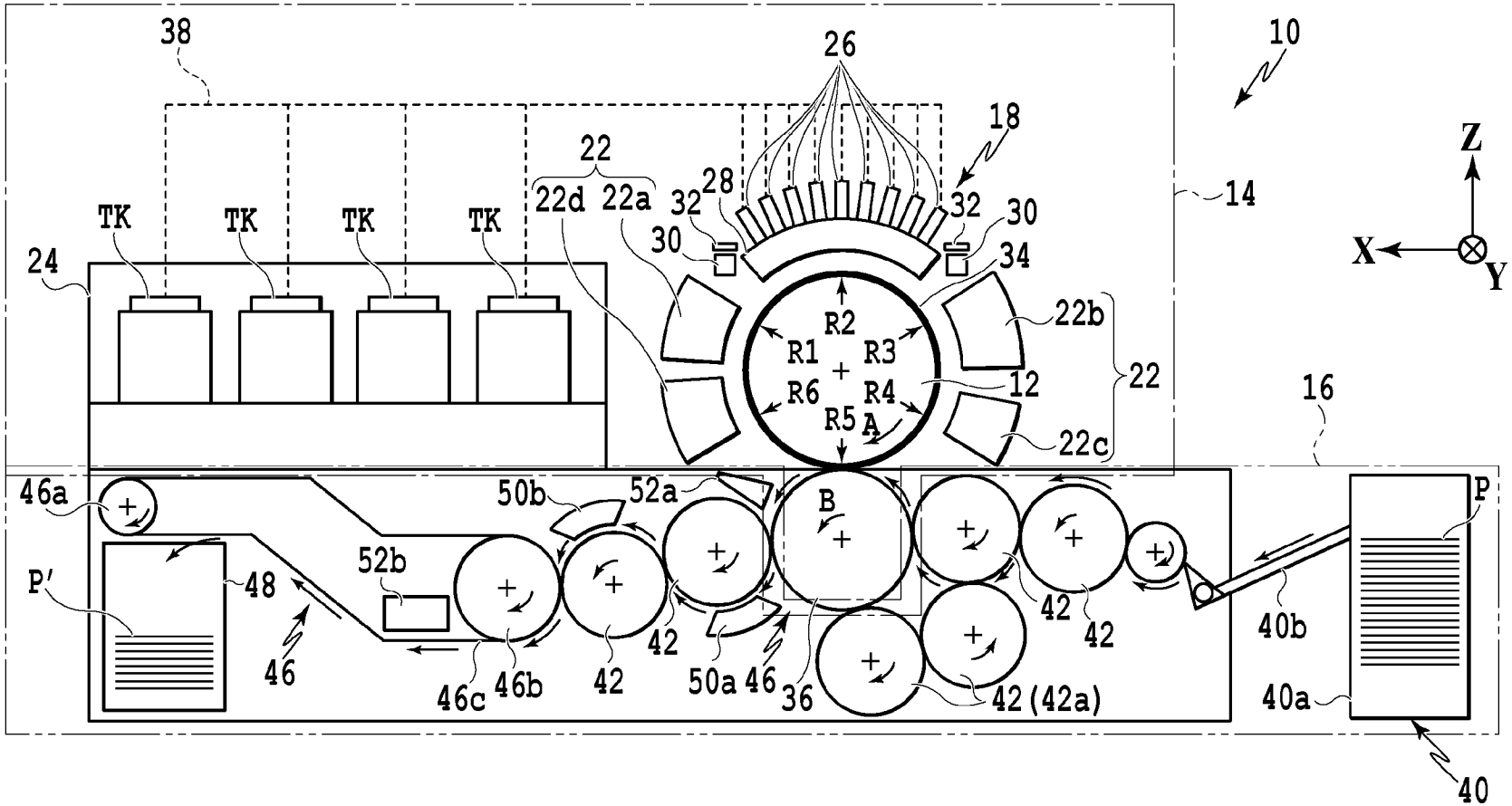
FIG. 1 is a schematic configuration diagram of a printing apparatus including a control device according to the present embodiment.

FIG. 1 is a schematic configuration diagram of a printing apparatus including a control device according to the present embodiment. The ink-jet printing apparatus 10 (hereinafter referred to as the "printing apparatus 10") is a sheet-fed ink-jet printing apparatus that transfers an ink image to a print medium P via a transfer body 12 so as to produce a printed product P'. The printing apparatus 10 includes a printer 14 that performs printing on the print medium P, a conveyance unit 16 that conveys the print medium P and the printed product P', and a control unit 17 (see FIG. 3) that controls the overall operation of the printing apparatus 10. In the present embodiment, the X-direction, the Y-direction, and the Z-direction, which are orthogonal to each other, respectively indicate the width direction (total length direction), the depth direction, and the height direction of the printing apparatus 10 in FIG. 1. Note that the print medium P is conveyed in the X-direction. In the present embodiment, the control unit 17 corresponds to the control device that controls the printing apparatus.

Here, in the present specification, "printing" does not simply indicate a case of forming meaningful information such as a character or a figure. That is, a case of processing a medium or forming an image, a design, a pattern, or the like on a print medium in a broad sense regardless of being meaningful or meaningless is also included, and the formed object does not have to be elicited in such a manner that a human can visually perceive. Furthermore, although it is assumed that the "print medium" is sheet-shaped paper in the present embodiment, it is possible that the "print medium" is a cloth, a plastic film, or the like.

Although there is no particular limitation regarding the components of ink, it is assumed in the present embodiment that aqueous pigment ink, which including pigment, water, or resin to be used as a color material, is used.

(Printer)

The printer 14 includes a printing unit 18 that ejects ink and a transfer unit 20 that transfers the ink ejected from the printing unit 18 to a print medium. In addition, a peripheral unit 22 arranged around the transfer unit 20 and a supply unit 24 that supplies ink to the printing unit 18 are included.

<Printing Unit>

Figure 2:
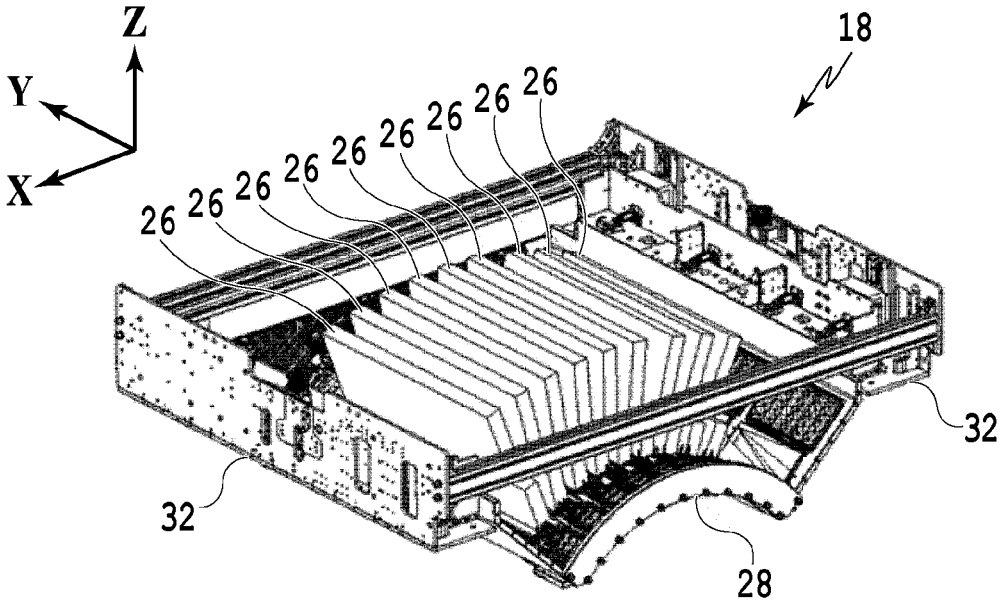
FIG. 2 is a perspective configuration diagram of a printing unit.

FIG. 2 is a perspective configuration diagram of the printing unit 18. The printing unit 18 includes multiple print heads 26 that eject ink, which is supplied from the supply unit 24, and a carriage 28 that holds the print heads 26 and moves the print heads 26.

The print heads 26 eject ink onto the transfer body 12 (described later) of the transfer unit 20, so as to form an ink image of an image to be printed on the transfer body 12. In the present embodiment, each print head 26 is a full line head extending in the Y-direction, and an array of nozzles (not illustrated in the drawings) for ejecting ink is arranged in the range that covers the width size of the image printable region of a print medium in the maximum size possible for printing. Each print head 26 has the ejection openings of the nozzles, which are formed on the surface facing the transfer body 12. Note that, in the present specification, a nozzle is formed of an ejection opening from which ink is ejected and a flow path for supplying ink to the ejection opening. Hereinafter, the surface of a print head 26 that faces the transfer body 12 may be referred to as the "ejection opening surface" as appropriate. The ejection opening surface faces the front surface of the transfer body 12 with a predetermined gap (for example, several millimeters) provided therebetween. In the present embodiment, since the transfer body 12 is configured to move cyclically on a circular orbit, the multiple print heads 26 are radially arranged in the printing unit 18.

An ejection energy generating element (not illustrated in the drawings) is mounted in the flow path of each nozzle of the print heads 26. For example, the ejection energy generating element is an element that generates pressure in the nozzle, so as to eject the ink in the flow path from the ejection opening, for which various publicly-known technologies can be applied. Specifically, for example, the ejection energy generating element is an element that generates film-boiling of ink by use of an electro-thermal converter and forms an air bubble, so as to eject ink. In addition, for example, an element that ejects ink by use of an electro-mechanical converter, an element that utilizes static electricity to eject ink, or the like may be employed. From the viewpoint of printing at high speed and high density, it is preferable to use an ejection energy generating element that utilizes an electro-thermal converter.

In the present embodiment, nine print heads 26 are mounted. Each of the print heads 26 ejects a different type of ink. Specifically, each type of ink contains a different color material and may be yellow ink, magenta ink, cyan ink, black ink, or the like. Note that there may be such a configuration in which one type of ink is ejected from one print head 26 or such a configuration in which multiple types of ink are ejected from one print head 26. Furthermore, it is also possible that the same type of ink is ejected from multiple print heads 26. Note that there may be such a configuration in which ink that contains no color material, for example, clear ink, is ejected from a print head 26.

The carriage 28 supports each print head 26. An end portion of each print head 26 on the ejection opening surface side is fixed to the carriage 28, and, accordingly, the predetermined amount of gap between the ejection opening surface and the front surface of the transfer body 12 is maintained. The carriage 28 is configured to be guided by a pair of guide members 30, so as to be movable with the print heads 26 being mounted. In the present embodiment, the pair of guide members 30 are rail members extending in the Y-direction and are mounted so as to be separated from each other in the X-direction. On each of the side portions of the carriage 28 in the X-direction, there is mounted a slide portion 32 that engages with a guide member 30 and is able to slide along the guide member 30. Accordingly, the carriage 28 is configured to be movable in the Y-direction. Therefore, each print head 26 mounted on the carriage 28 is configured to be movable in the Y-direction via the carriage 28.

<Transfer Unit>

The transfer unit 20 includes a transfer cylinder 34 that supports the transfer body 12 on the outer peripheral surface thereof and a cylinder 36 that makes a pressure contact with the transfer cylinder 34 (transfer body 12). The transfer cylinder 34 and the cylinder 36 are rotational bodies in approximately cylindrical shapes, which rotate on a rotation axis extending in the Y-direction. The transfer cylinder 34 rotates in the direction of Arrow A, and the cylinder 36 rotates in the direction of Arrow B.

On the outer peripheral surface of the transfer cylinder 34, there is mounted the transfer body 12 in a continuous or intermittent manner in the circumferential direction. In a case where the transfer body 12 is in an continuous manner, the transfer body 12 is formed as an endless belt. In a case where the transfer body 12 is in an intermittent manner, the transfer body 12 is formed separately in multiple segments as belts with ends, and each segment is arranged on the outer peripheral surface of the transfer body 12 at regular intervals in a shape of a circular arc.

Because of the rotation of the transfer cylinder 34, the transfer body 12 cyclically moves on a circular orbit. Depending on the rotational phase of the transfer cylinder 34, the position of the transfer body 12 can be segmented into an ejection preprocessing region R1, an ejection region R2, ejection post-processing regions R3 and R4, a transfer region R5, and a transfer post-processing region R6. The transfer body 12 cyclically passes by the regions R1 to R6.

The ejection preprocessing region R1 is a region in which the application unit 22*a* (described later) of the peripheral unit 22 performs preprocessing on the transfer body 12 before ink is ejected by the printing unit 18. The ejection region R2 is a region in which the printing unit 18 ejects ink onto the transfer body 12 to form an ink image. The ejection post-processing regions R3 and R4 are regions for performing processing on the ink image formed on the transfer body 12. Specifically, in the ejection post-processing region R3, the processing by the absorption unit 22*b* (described later) of the peripheral unit 22 is performed, and, in the ejection post-processing region R4, the processing by the heating unit 22*c* (described later) of the peripheral unit 22 is performed. The transfer region R5 is a region in which the ink image formed on the transfer body 12 is transferred to the print medium P held by the cylinder 36. The transfer post-processing region R6 is a region in which post-processing is performed on the transfer body 12 by the cleaning unit 22*d* (described later) of the peripheral unit 22 after the ink image is transferred to the print medium P.

In the present embodiment, the ejection region R2 is a region having a predetermined length in the circumferential direction of the transfer cylinder 34. The ejection preprocessing region R1, the ejection post-processing regions R3 and R4, the transfer region R5, and the transfer post-processing region R6 are regions whose lengths in the circumferential direction of the transfer cylinder 34 are shorter than that of the ejection region R2. Further, in the present embodiment, if the arrangement positions of the respective regions are compared to those in a dial face of a clock, the ejection preprocessing region R1 is at a position of about 10:00, the ejection region R2 is in a range of about 11:00 to 13:00, and the ejection post-processing region R3 is at a position of about 14:00. Furthermore, the ejection post-processing region R4 is at about 16:00, the transfer region R5 is at a position of about 18:00, and the transfer post-processing region R6 is at a position of about 20:00.

The transfer body 12 may be configured with a single layer or may be configured as a laminate of multiple layers. For example, in a case where the transfer body 12 is configured with multiple layers, the multiple layers include the three layers of a surface layer, an elastic layer, and a compression layer. The surface layer is an outermost layer having an image-formed surface on which an ink image is formed. With the compression layer, since the compression layer absorbs deformation and disperses local pressure fluctuation, it is possible to maintain the transferability even during high-speed printing. The elastic layer is formed between the surface layer and the compression layer.

As the material of the surface layer, although various kinds of materials such as resins and ceramics can be used as appropriate, it is preferable to use a material having a high compressive elastic modulus in view of durability, etc. Specifically, an acrylic resin, an acrylic silicone resin, a fluorine-containing resin, a condensate obtained by condensing a hydrolytic organosilicon compound, or the like is used as the material of the surface layer. A surface treatment may be performed on the surface layer in order to improve the wettability of the reaction liquid applied by the application unit 22*a*, the transferability of the ink image, etc. The surface treatment may be flame treatment, corona treatment, plasma treatment, polishing treatment, roughening treatment, active energy radiation irradiation treatment, ozone treatment, surfactant treatment, silane coupling treatment, and the like. Note that, as the surface treatment, some of the above-described treatments may be combined. Furthermore, the surface layer may be provided with a given surface profile.

As the material of the compression layer, for example, acrylonitrile-butadiene rubber, acrylic rubber, chloroprene rubber, urethane rubber, silicone rubber, or the like is used. At the time of shaping the rubber material, it is possible to blend a predetermined amount of vulcanizing agent, vulcanization accelerator, or the like, and further blend a filler such as foaming agent, hollow fine particles, or salt as necessary, so as to form a porous rubber material. In a case where the compression layer is made of a porous rubber material, since the air bubble part is compressed with a volume change in response to various pressure fluctuations, there is little deformation in directions other than the compression direction, so that more stable transferability and durability can be obtained. As the porous rubber material, there are a continuous pore structure, in which the pores are mutually continuous, and an independent pore structure, in which each pore is independent, and either one of the structures is possible and the combination of both of the structures is possible as well.

As the material of the elastic layer, various kinds of materials such as resins and ceramics can be used as appropriate. Various kinds of elastomer materials and rubber materials can be used in view of the processing characteristics, etc. Specifically, for example, fluorosilicone rubber, phenylsilicone rubber, fluororubber, chloropropylene rubber, urethane rubber, nitrile rubber, or the like can be used. Furthermore, ethylene propylene rubber, natural rubber, styrene rubber, isoprene rubber, butadiene rubber, ethylene/propylene/butadiene copolymer, nitrile butadiene rubber, or the like can be used as well. Silicone rubber, fluorosilicone rubber, and phenylsilicone rubber particularly have a small compression set and, therefore, are preferred as materials for the elastic layer in view of dimensional stability and durability.

Between the surface layer and the elastic layer and between the elastic layer and the compression layer, various kinds of adhesive agents or two-sided adhesive tapes are used for fixing the layers together. In addition, the transfer body 12 may include a reinforcing layer having a high compressive elastic modulus in order to suppress lateral extension when the transfer body 12 is mounted on the transfer cylinder 34 and to maintain rigidity. A woven fabric may be used as the reinforcing layer, for example. Furthermore, the transfer body 12 may be formed with a given combination of layers made of the above-described materials.

The cylinder 36 is mounted at a position facing the transfer region R5 on the transfer cylinder 34, and the outer peripheral surface of the cylinder 36 is made to be in pressure contact with the transfer body 12. On the outer peripheral surface of the cylinder 36, there is mounted a gripping mechanism (not illustrated in the drawings) for holding the leading end portion of the print medium P. As for the gripping mechanism, it is possible that only one gripping mechanism is mounted, and it is also possible that multiple gripping mechanisms are mounted such that each of the multiple gripping mechanisms is separated from each other in the circumferential direction on the cylinder 36. When the print medium P passes through the nipping part between the cylinder 36 and the transfer body 12 while being conveyed in tight contact with the outer peripheral surface of the cylinder 36, the ink image on the transfer body 12 is transferred to the print medium P.

<Peripheral Unit>

The peripheral unit 22 is arranged around the transfer cylinder 34 so as to face the outer peripheral surface of the transfer cylinder 34. In the present embodiment, the application unit 22*a* is arranged at a position facing the ejection preprocessing region R1. Furthermore, the absorption unit 22*b* and the heating unit 22*c* are arranged at positions facing the ejection post-processing regions R3 and R4, respectively, and the cleaning unit 22*d* is arranged at a position facing the transfer post-processing region R6.

The application unit 22*a* is a mechanism for applying reaction liquid onto the transfer body 12 before ink is ejected by the printing unit 18. The reaction liquid is a liquid containing a component that increases the viscosity of ink. Here, increasing of the viscosity of ink means that a color material, resin, or the like, which is constituting the ink, makes contact with a component for increasing the viscosity of the ink and chemically reacts with or physically adsorbs the component, so that the velocity of the ink is increased. In addition, not only a case in which the viscosity of the entire ink is increased, increasing the viscosity of ink also includes a case in which a part of components constituting the ink, such as a color material or resin, agglutinates, so that the viscosity is locally increased.

The component that increases the viscosity of the ink is not particularly limited and may be a metal ion and a polymer coagulant. Further, a substance that causes a pH change of ink to coagulate the color material in the ink, such as an organic acid, can be used. Specific examples of the reaction liquid applying mechanism include a roller, a print head, a die coating device (die coater), a blade coating device (blade coater), and the like. By applying the reaction liquid to the transfer body 12 before ink is ejected onto the transfer body 12, the ink can be immediately fixed on the transfer body 12. As a result, bleeding, in which adjacent ink droplets landed on the transfer body 12 mix with each other, can be suppressed.

The absorption unit 22*b* is a mechanism that absorbs the liquid component from the ink image on the transfer body 12 before the transfer. By reducing the liquid component of the ink image, bleeding of the image printed on the print medium P can be suppressed. In other words, the absorption unit 22*b* is a mechanism that concentrates the ink that configures the ink image on the transfer body 12. Concentrating the ink means that the liquid component included in the ink is reduced, so that the content ratio of the solid contents, such as the color material and the resin included in the ink, to the liquid component is increased.

Specifically, for example, the absorption unit 22*b* is configured to include a liquid absorbing member that makes contact with the ink image to reduce the liquid component of the ink image. In this case, the liquid absorbing member may be formed on the outer peripheral surface of the roller, or the liquid absorbing member may be formed as an endless sheet so as to cyclically run. Furthermore, for the purpose of protecting the ink image, the movement speed of the liquid absorbing member may be matched with the circumferential velocity of the transfer body 12, and the liquid absorbing member may be moved in synchronization with the transfer body 12.

Moreover, the liquid absorbing member may include a porous body that makes contact with the ink image. In this case, in order to prevent the solid content of ink from adhering to the liquid absorbing member, the pore diameter of the porous body on the surface that makes contact with the ink image may be 10 μm or less. Here, the pore diameter means an average diameter, which can be measured by a publicly-known methods such as a mercury intrusion method, a nitrogen adsorption method, or SEM (Scanning Electron Microscope) image observation. Note that the liquid component that can be absorbed by the liquid absorbing member is not particularly limited as long as the liquid component does not have a fixed shape, has fluidity, and has substantially constant volume. That is, water, organic solvent, etc., contained in the ink or the reaction liquid are examples of the above-described liquid component.

The heating unit 22*c* is a mechanism that heats the ink image on the transfer body 12 before the transfer. By heating the ink image, the resin in the ink is melted and the transferability to the print medium P is improved. The heating temperature is, for example, a minimum film forming temperature (MFT) of the resin in the ink or higher. The MFT can be measured by a generally known method, for example, by each device conforming to JIS K 6828-2:2003, IS02115: 1996, etc. From the viewpoint of transferability and fastness of an image, the heating may be performed at a temperature higher than the MFT of the resin in the ink by 10° C. or more, or even at a temperature higher than the MFT by 20° C. or more. Specifically, as the heating unit 22*c*, a publicly-known heating device such as various kinds of lamps to generate infrared rays, etc., a warm air fan, or the like can be used. Note that, from the viewpoint of heating efficiency, it is preferable to use an infrared heater as the heating unit 22*c*.

The cleaning unit 22*d* is a mechanism that cleans the transfer body 12 after the transfer. That is, the cleaning unit 22*d* removes ink remaining on the transfer body 12, dust on the transfer body 12, etc. Specifically, as the cleaning unit 22*d*, for example, various kinds of publicly-known systems, such as a system in which a porous member is made in contact with the transfer body 12, a system in which the front surface of the transfer body 12 is rubbed by a brush, or a system in which the front surface of the transfer body 12 is scraped by a blade, may be used as appropriate. Furthermore, the shape of the cleaning member used for cleaning is not particularly limited and may be roller-shaped, web-shaped, or the like.

The peripheral unit 22 may further include a cooling unit (not illustrated in the drawings) that cools the transfer body 12. Note that, instead of adding the cooling unit, a cooling function for cooling down the transfer body 12 may be added to some of the application unit 22*a*, the absorption unit 22*b*, the heating unit 22*c*, and the cleaning unit 22*d*. In the present embodiment, the temperature of the transfer body 12 tends to rise due to the heat of the heating unit 22*c*. In a case where the ink temperature of the ink image exceeds the boiling point of the main solvent (for example, water) of the ink after the ink is ejected by the printing unit 18 onto the transfer body 12, the absorbing ability of the absorption unit 22*b* for liquid components may deteriorate. By cooling the transfer body 12 so that the temperature of the main solvent of the ejected ink is maintained to be below the boiling point, it is possible to maintain the absorbing ability of the absorption unit 22*b* for liquid components.

The cooling unit may have an air blowing mechanism that blows air to the transfer body 12 or may be configured to make a member such as a roller that is cooled by air or water make contact with the transfer body 12. The timing of cooling is, for example, a period after the transfer of the ink image is completed and before the reaction liquid is applied.

<Supply Unit>

The supply unit 24 is a mechanism that supplies ink to each print head 26 of the printing unit 18. For example, the supply unit 24 is mounted on the downstream side in the conveyance direction of the print medium Pin the printing apparatus 10. The supply unit 24 includes reservoir units TK that reserve ink for each type. A reservoir unit TK may be configured with a main tank (not illustrated in the drawings) and a sub tank (not illustrated in the drawings). Each reservoir unit TK and each print head 26 communicate with each other via a flow path 38, and the ink reserved in a reservoir unit TK is supplied to the print head 26 via the flow path 38. The flow path 38 may be configured to circulate ink between a reservoir unit TK and a print head 26 by use of a pump or the like. A deaeration mechanism for deaerating air bubbles in the ink may be mounted in the flow path 38 or the reservoir units TK. Further, a valve for adjusting the atmospheric pressure and the liquid pressure of ink may be mounted in the flow path 38 or the reservoir units TK. Moreover, in the supply unit 24, the arrangement positions of the reservoir units TK and the print heads 26 in the height direction (Z-direction) may be designed so that the position of the liquid surface of the ink in the reservoir units TK is lower than the ink ejection surface of the print heads 26.

(Conveyance Unit)

The conveyance unit 16 is a device that feeds a print medium P to the transfer unit 20 and collects the printed product P' onto which the ink image has been transferred by the transfer unit 20. The conveyance unit 16 includes a feeding unit 40 for feeding a print medium P that has been contained and a conveyance cylinder 42 for conveying the fed print medium. In addition, a conveyance mechanism 46 for conveying the printed product P' to the collection unit 48 (described later) and the collection unit 48 for collecting the printed product P' conveyed by the conveyance mechanism 46 are included. Furthermore, a post-processing unit 50 for performing post-processing on the printed product P' and an image-capturing unit 52 that captures the image printed on the printed product P' are included.

In FIG. 1, regarding the figures indicating the respective configurations of the conveyance unit 16, the internal arrows indicate the rotational directions of the respective configurations, and the external arrows indicate the conveyance route of the print medium P or printed product P'. The print medium P is conveyed from the feeding unit 40 to the collection unit 48 via the conveyance cylinders 42, the transfer unit 20, and the conveyance mechanism 46. In the present specification, the upstream side of the conveyance direction, which is on the feeding unit 40 side, may be referred to as the "upstream side" as appropriate, and the downstream side of the conveyance direction, which is on the collection unit 48 side, may be referred to as the "downstream side" as appropriate.

<Feeding Unit>

The feeding unit 40 includes a loading unit 40*a* in which multiple print media are loaded and contained and a supply mechanism 40*b* that supplies the print media P one by one from the loading unit 40*a* to the conveyance cylinder 42 positioned on the most upstream side.

<Conveyance Cylinder>

There are mounted multiple conveyance cylinders 42 (seven conveyance cylinders in the present embodiment), each of which is a rotational body in an approximately cylindrical shape that rotates on a rotation axis extending in the Y-direction. On the outer peripheral surface of each conveyance cylinder 42, there is mounted a gripping mechanism (not illustrated in the drawings) for holding the leading end portion of the print medium P (or the printed product P'). The gripping mechanism is controlled to perform gripping operation and releasing operation, so that the print medium P is delivered between adjacent conveyance cylinders 42.

The conveyance cylinders 42 include a conveyance cylinder 42*a* for flipping the print medium P. In a case of performing double-side printing on the print medium P, after transfer to the front surface of the print medium P, the print medium P is not delivered from the cylinder 36 to the adjacent conveyance cylinder 42 on the downstream side thereof, but the print medium P is delivered to the conveyance cylinder 42*a*, which is below and adjacent to the cylinder 36. The print medium P is flipped upside down via the conveyance cylinder 42*a* and is delivered again to the cylinder 36 via the conveyance cylinder 42 that is on the upstream side and adjacent to the cylinder 36. Accordingly, the back surface of the print medium P faces the transfer body 12, and the ink image can be transferred to the back surface.

<Conveyance Mechanism>

The conveyance mechanism 46 includes two sprockets 46*a* and 46*b* arranged at an interval in the X-direction and an endless chain 46*c* mounted in a tensioned state on the sprockets 46*a* and 46*b*. One of the sprockets 46*a* and 46*b* is a drive sprocket and the other is an associate sprocket. The chain 46*c* cyclically runs by driving of the drive sprocket. The chain 46*c* is provided with multiple gripping mechanisms (not illustrated in the drawings) at intervals in the X-direction. The gripping mechanisms grip an end portion of the printed product P'. The printed product P' is delivered from the conveyance cylinder 42 positioned at the end portion on the downstream side to the gripping mechanisms of the chain 46*c*, and the printed product P' gripped by the gripping mechanisms is conveyed to the collection unit 48 as the chain 46*c* runs, then the gripping by the gripping mechanisms is released. Accordingly, the printed product P' is collected into the collection unit 48.

<Post-Processing Unit>

The post-processing unit 50 includes a post-processing unit 50*a* mounted at a position facing the printed product P' held by the conveyance cylinder 42 that is on the downstream side and adjacent to the cylinder 36. Furthermore, a post-processing unit 50*b* mounted at a position facing the printed product P' held by the conveyance cylinder 42 that is on the upstream side and adjacent to the conveyance mechanism 46 is included. The post-processing unit 50*a* performs processing on the back surface of the printed product P', and the post-processing unit 50*b* performs processing on the front surface of the printed product P'. As specific details of processing, for example, the image printing side of the printed product P' is coated for the purpose of protection and glossing for the image. The contents of the coating includes, for example, application of liquid, welding of a sheet, lamination, and the like.

<Image-Capturing Unit>

The image-capturing unit 52 includes an image-capturing unit 52*a* for capturing the image printed on the printed product P' held by the cylinder 36 and an image-capturing unit 52*b* for capturing the image printed on the printed product P' held by the chain 46*c*. For example, the image-capturing units 52*a* and 52*b* are imaging elements such as CCD sensors and CMOS sensors.

The image-capturing unit 52*a* captures the image to be printed during printing operation that is performed continuously. Based on the image captured by the image-capturing unit 52*a*, for example, the processing unit 54 (described later) checks the secular change such as the tint of the image to be printed. Based on this result, the processing unit 54 determines whether the image data or the print data can be corrected or not. In the present embodiment, the image-capturing unit 52*a* is arranged at a position facing the outer peripheral surface of the cylinder 36, so that, immediately after transfer, the image to be printed can be partially captured. Note that the image-capturing unit 52*a* may check all printed products P' or may check a printed product P' for a predetermined number of sheets.

The image-capturing unit 52*b* captures an image of the maintenance pattern (described later) and an image of the test pattern (described later) in the update processing (described later). The image-capturing unit 52*b* captures the entire image of each pattern. For example, the image information captured by the image-capturing unit 52*b* is output to the processing unit 54, so that an image processing table to be used for image processing performed on image data is generated based on the image information. In a case where a pattern is captured by the image-capturing unit 52*b*, the chain 46*c* is controlled to temporarily stop running, so as to capture the entire image of the pattern. The image-capturing unit 52*b* may be a scanner that scans on the printed product P' held by the chain 46*c*.

(Control Unit)

Figure 3:
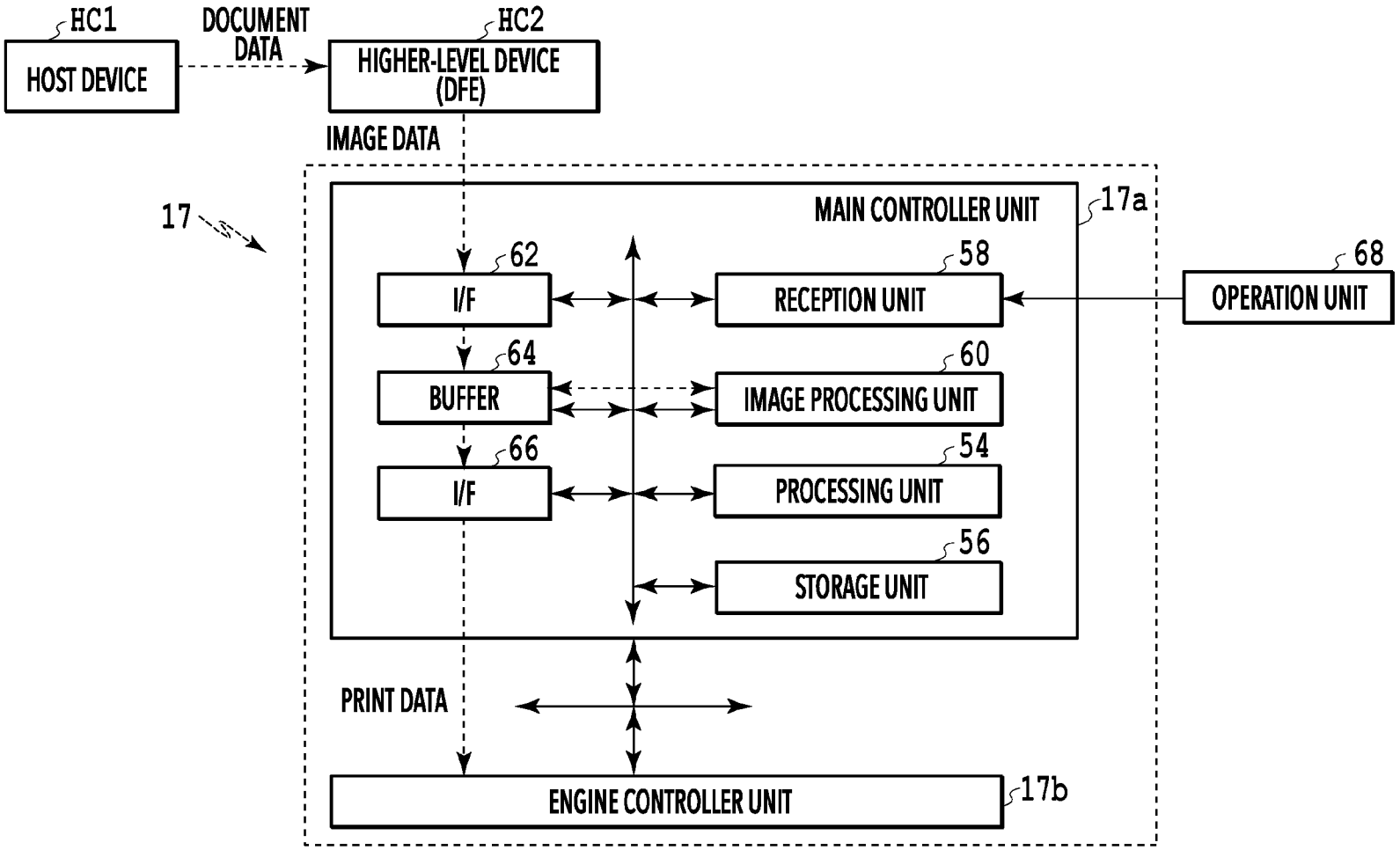
FIG. 3 is a block configuration diagram of a control unit.
Figure 4:
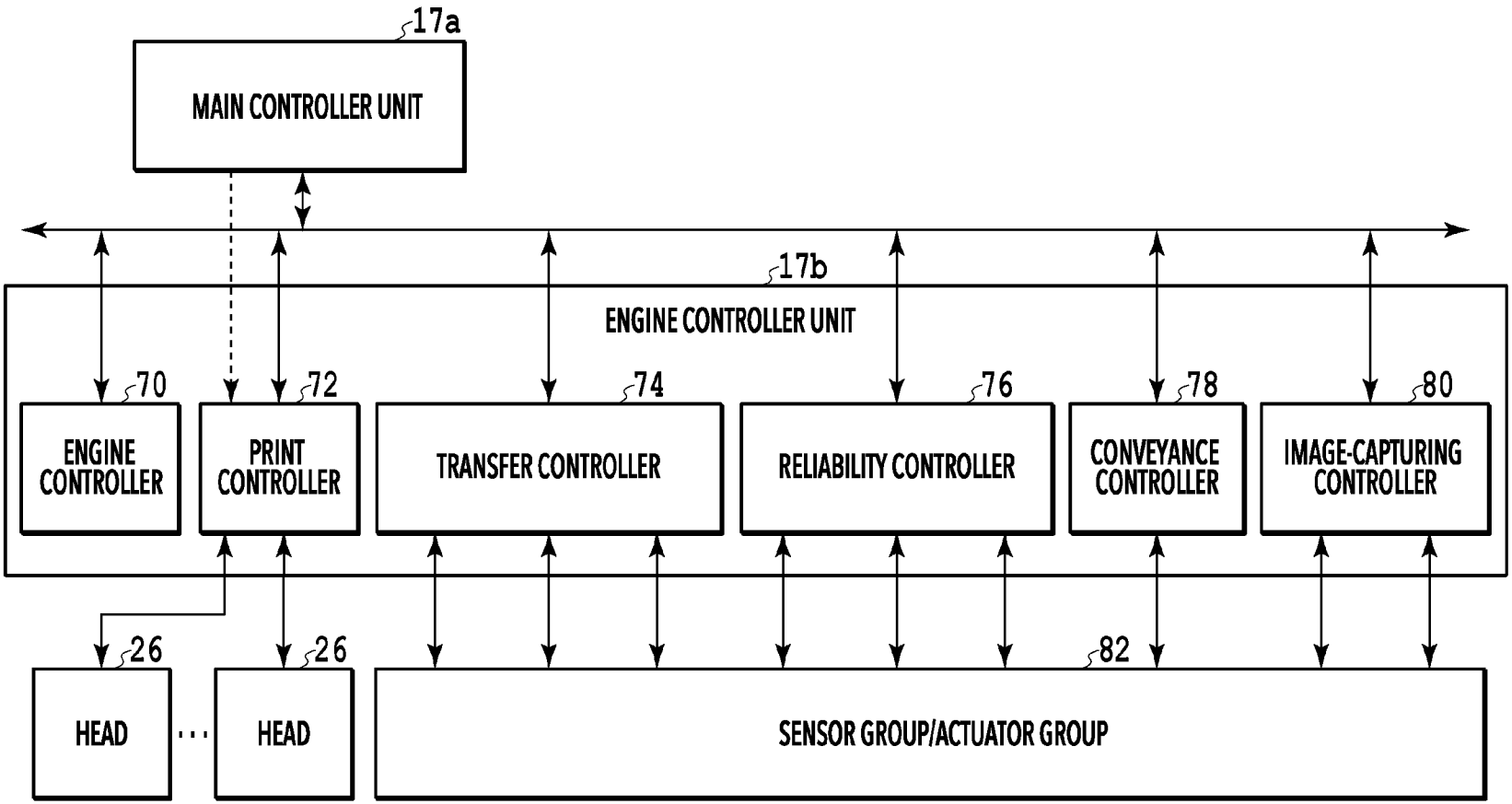
FIG. 4 is a block configuration diagram of an engine controller unit.

Next, a detailed explanation is given of the control unit 17 that controls the overall operation of the printing apparatus 10 with reference to FIG. 3 and FIG. 4. FIG. 3 is a block configuration diagram of the control unit 17. FIG. 4 is a block configuration diagram of the engine controller unit 17*b*. The control unit 17 is communicably connected to a higher-level device (DFE: Digital Front End Processor) HC2, and the higher-level device HC2 is communicably connected to the host device HC1.

The host device HC1 generates or saves document data that is a source of an image to be printed. The document data is generated in a format of an electronic file such as a document file or an image file, for example. The document data is sent to the higher-level device HC2, and the higher-level device HC2 converts the received document data into a data format that can be utilized by the control unit 17 (for example, RGB data that represents an image in RGB). The converted data is sent from the higher-level device HC2 to the control unit 17 as image data, and the control unit 17 starts printing operation based on the received image data or the like. In the present embodiment, the control unit 17 includes a main controller unit 17*a* and an engine controller unit 17*b*.

<Main Controller Unit>

The main controller unit 17*a* includes a processing unit 54, a storage unit 56, a reception unit 58, an image processing unit 60, a communication I/F (interface) 62, a buffer 64, and a communication I/F 66.

The processing unit 54 is a processor such as a CPU, and the processing unit 54 executes a program stored in the storage unit 56 and entirely controls the main controller unit 17*a*. The storage unit 56 is a storage device such as a RAM, a ROM, an HDD, or an SDD, and the storage unit 56 stores data and a program to be executed by the processing unit 54 and provides the processing unit 54 with a work area. The reception unit 58 receives an instruction from the user via the operation unit 68 such as a touch panel, a keyboard, and a mouse.

The image processing unit 60 is, for example, an image processing processor. Details of the image processing unit 60 will be described later. The buffer 64 is, for example, a RAM, an HDD, or an SDD. The communication I/F 62 communicates with the higher-level device HC2, and the communication I/F 66 communicates with the engine controller unit 17*b*. In FIG. 3, the dashed arrows indicate examples of flows of data, and the image data received from the higher-level device HC2 via the communication I/F 62 is stored in the buffer 64. The image processing unit 60 retrieves image data from the buffer 64, performs predetermined image processing to the retrieved image data, and stores the image data in the buffer 64 again. The image data after image processing, which is stored in the buffer 64, is sent from the communication I/F 66 to the engine controller unit 17*b* as print data to be used by the print engine.

<Engine Controller Unit>

The engine controller unit 17*b* includes multiple controllers, and the engine controller unit 17*b* controls driving and obtains detection results of a sensor group and an actuator group mounted in the printing apparatus 10. Each controller includes a processor such as a CPU, a storage device such as a ROM and a RAM, an interface with an external device, and the like. Note that the segmentation of the controllers shown in the present embodiment is an merely example, and it is possible that a part of the control is executed by further-segmented multiple controllers and it is also possible that the multiple controllers are integrated, so that the contents of the control are executed by one controller.

The engine controller 70 entirely controls the engine controller unit 17*b*. The print controller 72 converts print data that is output from the main controller unit 17*a* into a data format suitable for driving the print heads 26, such as raster data. Furthermore, the print controller 72 performs ink ejection control for the print heads 26. The transfer controller 74 controls the application unit 22*a*, the absorption unit 22*b*, the heating unit 22*c*, and the cleaning unit 22*d*.

The reliability controller 76 controls the supply unit 24 and a recovery unit (not illustrated in the drawings) for maintaining and recovering the ink ejection state (ejection characteristics) of the print heads 26. Furthermore, the reliability controller 76 also controls a moving mechanism (not illustrated in the drawings) for moving the printing unit 18 between the ejecting position and the recovering position. Note that the ejecting position is a position where ink is applied to the transfer body 12. Furthermore, the recovering position is a position where the recovery unit can execute recovery processing on the print heads 26.

The conveyance controller 78 controls the conveyance unit 16. The image-capturing controller 80 controls the image-capturing units 52*a* and 52*b*. Furthermore, the image-capturing controller 80 outputs image information captured by the image-capturing units 52*a* and 52*b* to the main controller unit 17*a*. Note that, in the main controller unit 17*a*, for example, based on the input image information, the processing unit 54 performs various checks and determinations and executes various kinds of processing based on the results thereof. Of the sensor group/actuator group 82, the sensor group includes a sensor that detects the position and speed of a movable portion, a sensor that detects temperature, the image-capturing unit 52, and the like. The actuator group includes a motor for driving various kinds of driving portions, an electromagnetic solenoid, an electromagnetic valve, and the like.

(Print Processing)

Figure 5A:
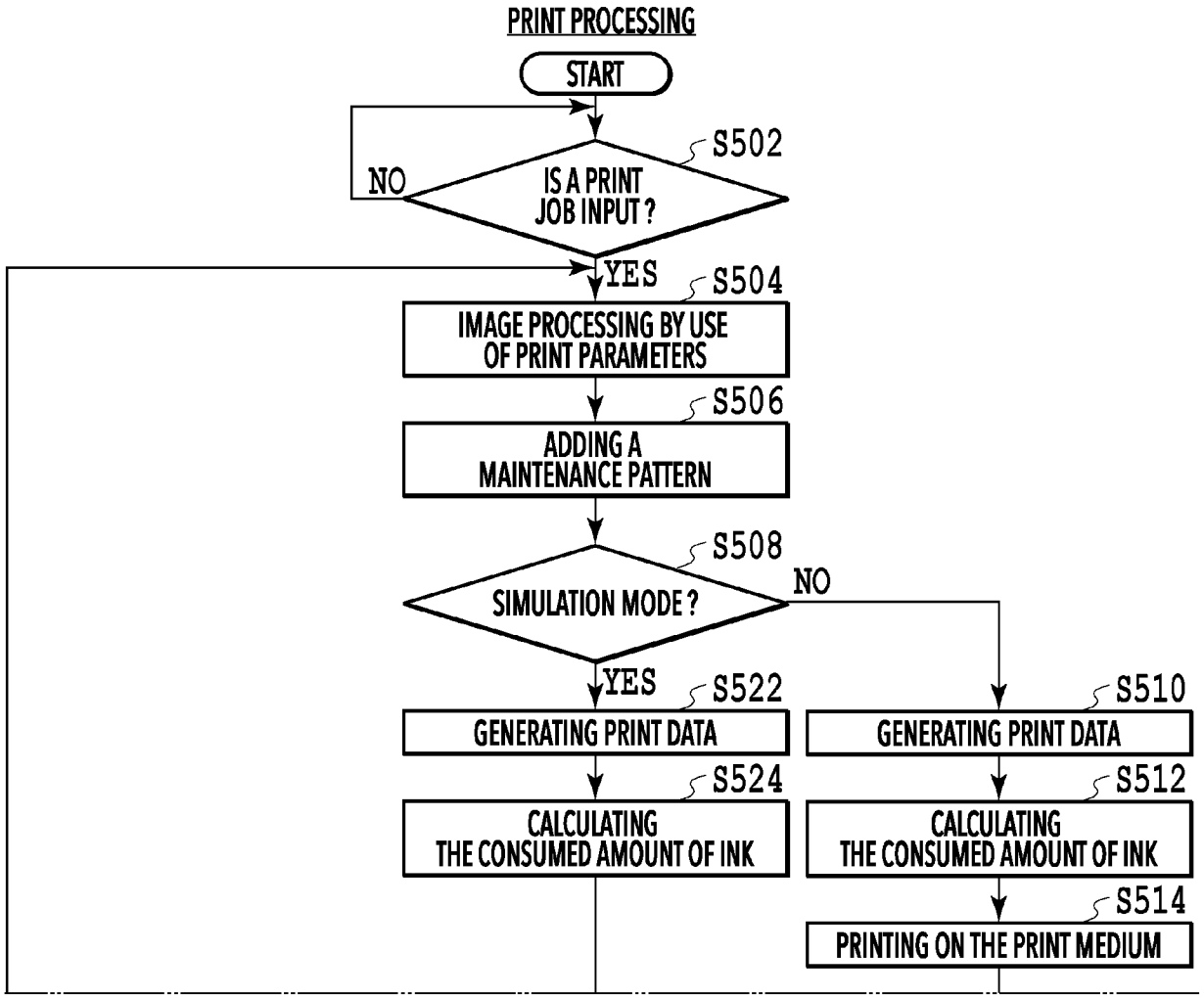
FIGS. 5A and 5B are flowcharts illustrating a detailed processing routine of print processing.
Figure 5B:
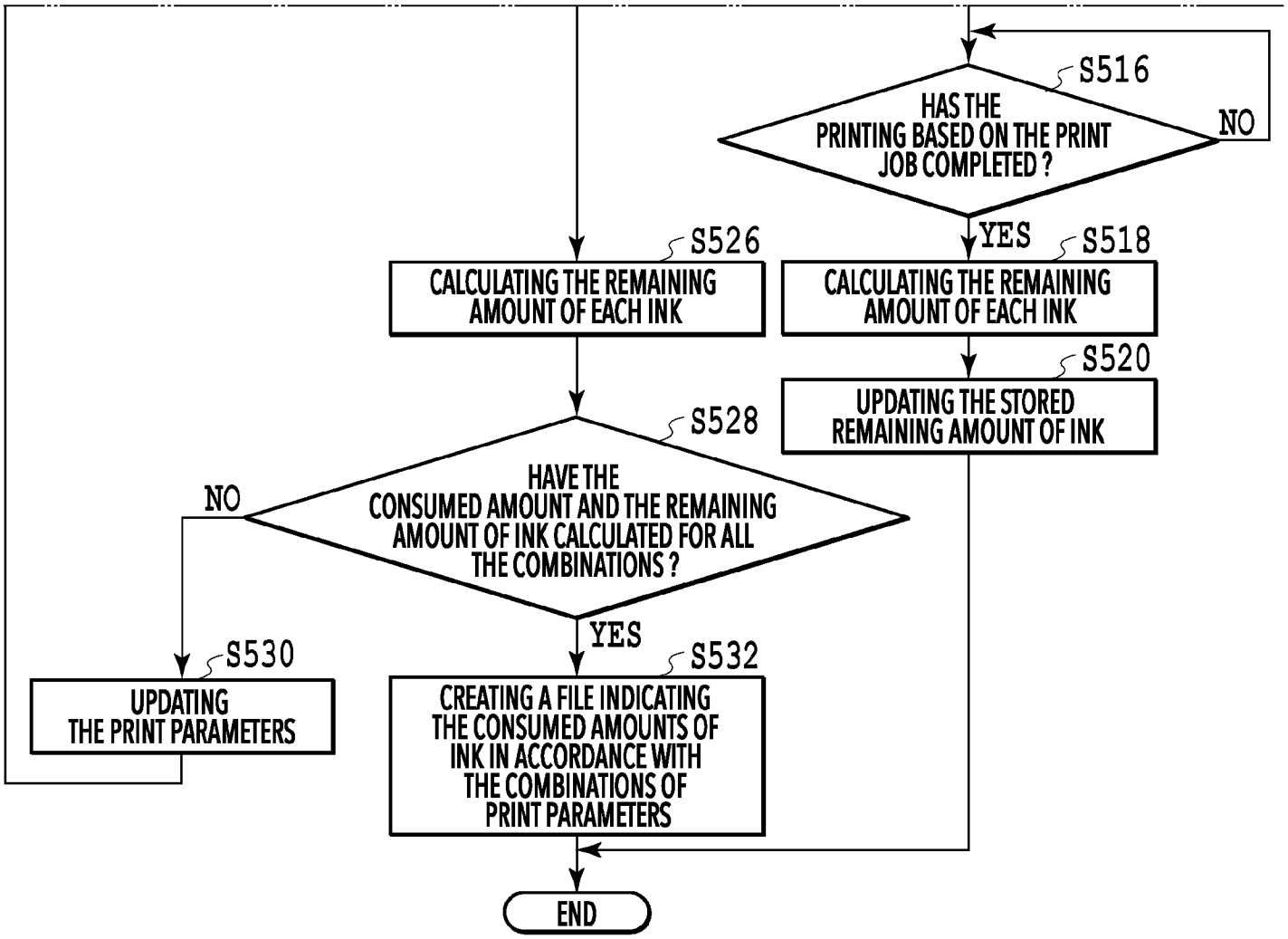

In the above-described configuration, in a case where the user gives an instruction to start the print processing, the processing unit 54 starts the print processing. Note that, in the print processing of the present embodiment, it is possible to select a print mode, in which printing is executed on the print medium P, and a simulation mode, in which the consumed amount of ink to be used for printing on the print medium P is calculated, so that the user selects given one of the modes. FIGS. 5A and 5B are flowcharts illustrating a detailed processing routine of the print processing. The print processing of FIGS. 5A and 5B is executed by the main controller. Note that, in a case of executing the simulation mode, an instruction for executing the simulation mode is input by the user via the operation unit 68 prior to the print processing of FIGS. 5A and 5B. Note that it is possible that information indicating whether the print mode is executed or the simulation mode is executed is included in a print job sent from the higher-level device HC2. Further, it is also possible that the information is sent from the higher-level device HC2 separately from the print job. In addition, it is also possible that input for the print mode or the simulation mode is provided from a mobile terminal such as a tablet connected to the printing apparatus 10 via a network, etc. As described above, in the present embodiment, the higher-level device HC2, the operation unit 68, the mobile terminal, or the like functions as a selector that can select the print mode (first mode) or the simulation mode (second mode).

In a case where the print processing is started, whether a print job is input or not is determined (S502). In the present embodiment, image data and a print job including print parameters indicating various kinds of conditions of printing are input to the printing apparatus 10 from the higher-level device HC2. That is, in the higher-level device HC2, not only image data is generated, but also print parameters, a mode (the print mode or the simulation mode), etc., are set. Note that RIP (Raster Image Processor) processing is performed on image data in the higher-level device HC2. The print parameters include not only information such as the number of sheets to be printed, the number of prints, and the type of print medium, but also a parameter related to the consumed amount of ink. The parameter related to the consumed amount of ink include information about print quality such as the number of ejected colors and resolution, information required for processing of maintaining and recovering qualities of printed products such as a maintenance pattern, which is for detecting a non-ejection nozzle and for detecting misregistration between colors, and the width thereof, and the like.

In a case where it is determined in S502 that a print job is input, the image processing unit 60 performs image processing in S504 according to the obtained print parameters. Specifically, first, conversion into a color space for the printing apparatus is performed. The color space obtained by this conversion changes depending on the number of colors to be ejected and the combination of colors. In the image processing, image processing according to the situations of the heads is further performed by referring to the table values of the image processing table, so that the ejection level for each ink color is calculated. The outline thereof is illustrated in portion (a) of FIG. 8. In portion (a) of FIG. 8, the table value of "a8", which is referred to in the image processing table for the image data in a print job, is determined according to an input pixel value, the position of the head that performs ejection for the pixel of the input pixel value, or the like. That is, each of the reference table values (reference value) of the image processing table is a value corresponding to a situation of a head (ejection characteristic). Therefore, since each of the table values of the image processing table is a value in consideration of a situation of a head, table values need to be updated in a case where the states of the print heads change. Note that the update processing of this table values will be described later.

In S506, the image processing unit 60 adds a maintenance pattern for detecting non-ejection nozzles and for detecting misregistration between colors to the margin area of the image, for which the image processing has been performed in S504. The maintenance pattern may not be added every time, and whether or not the maintenance pattern is added may be determined by the states of the heads.

Subsequently, in S508, the processing unit 54 determines whether the print mode is executed or the simulation mode is executed. In a case where execution of the simulation mode is input in advance, information indicating execution of the simulation mode is stored in the storage unit 56, and, in S508, the processing unit 54 makes determination based on the information stored in the storage unit 56. Note that, in a case of the simulation mode, printing on the print medium is not performed. That is, a command for driving the printing apparatus is issued for the engine controller unit 17*b* in the print mode, and a command for not driving the printing apparatus is issued for the engine controller unit 17*b* in the simulation mode.

In a case where it is determined in S508 that the print mode, not the simulation mode, is to be executed, the image data (including image data to which the maintenance pattern is added) is converted into print data in S510. Note that the print data is binary dot pattern data that represents ejection or non-ejection of ink from each print head 26. That is, in S510, the image processing unit 60 generates print data from the image data after the image processing. The dot number in the dot pattern is related to the ink ejection amount. In the present embodiment, the image processing unit 60 functions as a generating unit that generates print data. Thereafter, the processing unit 54 calculates the ink ejection amount, that is, the consumed amount of ink, for each ink color, based on the generated print data (S512). Specifically, the consumed amount of ink is calculated based on the number of "ejection"s in the print data. The dot pattern is formed so that, in a case where there is a non-ejection nozzle in a head, surrounding nozzles compensate for the non-ejection nozzle.

As for the print heads 26, for example, due to variations in the shapes of the flow paths and the sizes of the ejecting openings of the nozzles, variations in the characteristics of the ejection energy generating elements mounted in the respective nozzles, and the like, difference occurs in the ejection amount of ink from each nozzle. In addition, the size of an ejected ink droplet changes depending on the degree of exhaustion of the ejection opening. Therefore, in the update processing of the present embodiment, the ejection states of ink from the print heads 26 are detected, so that the image processing table is updated based on the detection result. Accordingly, the consumed amount of ink calculated in S512 reflects the ejection state ink of from each nozzle of the print heads 26.

For example, in a case where a non-ejection nozzle is present in the print heads 26, the ejection level is corrected so that the ejection amount of the nozzles around the non-ejection nozzle increases.

Next, printing on the print medium P is performed (S514). The main controller unit 17*a* outputs various kinds of information to the engine controller unit 17*b* together with the print data, so as to perform printing on the print medium P. Thereafter, whether the printing based on the print job has been completed or not is determined (S516). In a case where it is determined in S516 that the printing based on the print job has been completed, the remaining amount of each ink is calculated based on the consumed amount of ink calculated in S512 (S518). Specifically, the processing unit 54 calculates the remaining amount of each ink after printing by subtracting the consumed amount of ink, which is calculated in S512, from the remaining amount of each ink, which is stored in the storage unit 56. In the present embodiment, the processing unit 54 functions as a calculating unit that calculates the consumed amount of ink and the remaining amount of ink. Then, the value of the remaining amount of each ink stored in the storage unit 56 is updated to the value of the remaining amount of each ink calculated in S518 (S520), and the print processing ends.

On the other hand, in a case where it is determined in S508 that the simulation mode is to be executed, the image data is converted into print data (S522). Then, the ejection amount, that is, the consumed amount for each ink color is calculated based on the generated print data (S524). Note that, since the specific details of processing of S522 and S524 are the same as those of S510 and S512, respectively, the explanations thereof will be omitted.

Thereafter, the remaining amount of each ink is calculated (S526). Specifically, the remaining amount of each ink after printing is calculated by subtracting the consumed amount of ink, which is calculated in S524, from the remaining amount of each ink, which is stored in the storage unit 56. In this way, in the simulation mode, the remaining amount of each ink is calculated without outputting print data and print parameters to the engine controller unit 17*b* nor executing printing operation.

Next, whether or not the consumed amount and the remaining amount of ink have been calculated for all the combinations having different print parameters is determined (S528). The printing apparatus 10 stores multiple combinations having different values of print parameters related to the consumed amount of ink. Specifically, the storage unit 56 stores multiple combinations having different parameter values of print parameters related to the consumed amounts of ink such as the number of ejected colors and the resolution. Note that the values of print parameters in such combinations only need to be set in advance, and it is possible that the user can set the values of print parameters (parameter values) in each combination, as appropriate. Then, in the present embodiment, other than the consumed amount and the remaining amount of ink based on parameter values set according to the print job, the consumed amount and the remaining amount of ink are calculated based on parameter values set according to the combinations.

In a case where it is determined in S528 that the consumed amount and the remaining amount of ink have not been calculated for all the combinations, the parameter values of the respective print parameters in the combinations for which the calculation has not been performed are obtained. Then, after the print parameters are updated to the obtained parameter values (S530), the processing returns to S504 and the subsequent processes are performed. That is, in S530, among the respective print parameters input as the print job, the print parameter related to the consumed amount of ink is updated to the obtained parameter value, and the parameter values of the other print parameters are not updated.

As described above, in the present embodiment, the consumed amount and the remaining amount of ink in a case where the print parameters related to the consumed amount of ink have been changed are calculated for the same image data. As for print parameters for the sheet size, with which the size of the image to be printed changes, etc., those set according to the print job are used. It is possible that settings for imposition can be performed by the main controller unit 17*a* as well as the higher-level device HC2, and, in this case, print parameters for imposition are included in print parameters related to the consumed amount of ink. Print parameters for the sheet size and magnification are not included in print parameters related to the consumed amount of ink.

Furthermore, in a case where it is determined in S528 that the consumed amount and the remaining amount of ink have been calculated for all the combinations, a file capable of notifying of the calculated consumed amounts and the remaining amounts of ink is created (S532), and the print processing ends. Regarding the created file, as illustrated in FIG. 6 for example, the remaining ink amount after printing as well as the ink ejection amount (consumed amount) for each ink color at the time of printing are displayed for each of the combinations having different parameter values of the print parameters related to the consumed amount of ink. Furthermore, it is preferable that the file is created in such a format that variations of the consumed amounts of ink based on differences in print parameters can be compared. The created file is stored in the storage unit 56, and it is possible for the user to obtain the created file via the operation unit 68, the higher-level device HC2, and the like, as appropriate. There is no particular limitation regarding the format of the file, and the format may be a table file or a text file such as CSV (comma-separated value). In addition, it is preferable to adopt such a format that the user can easily recognize the consumed amounts of ink based on the difference in the print parameters. As a result, according to the created file, the differences in the consumed amounts and the remaining amounts of ink at the time where the print parameters related to the consumed amount of ink have been changed can be checked by the user for the same image data.

(Update Processing)

Here, the update processing for the image processing table will be explained. As described above, the values of the image processing table (hereinafter also referred to as the "table values") have effects to the ejection amount of ink. Note that the update processing for the image processing table is executed at a predetermined timing. The predetermined timing is determined according to the state of the printing apparatus 10 and, for example, may be determined according to the number of sheets to be printed. Furthermore, for example, the predetermined timing may be the timing of the start of the printing operation and the timing where a predetermined number of sheets have been printed since the most recent update processing. A given timing can be set by the user as the predetermined timing.

In the update processing, a test pattern generated by the image processing unit 60 is used. Note that the test pattern may be stored in the storage unit 56 in advance. This test pattern is a pattern printed by use of all nozzles for each ink color, that is, for each print head 26, and, for example, the test pattern is a gradation pattern in which the print density gradually increases in a predetermined direction.

Figure 7:
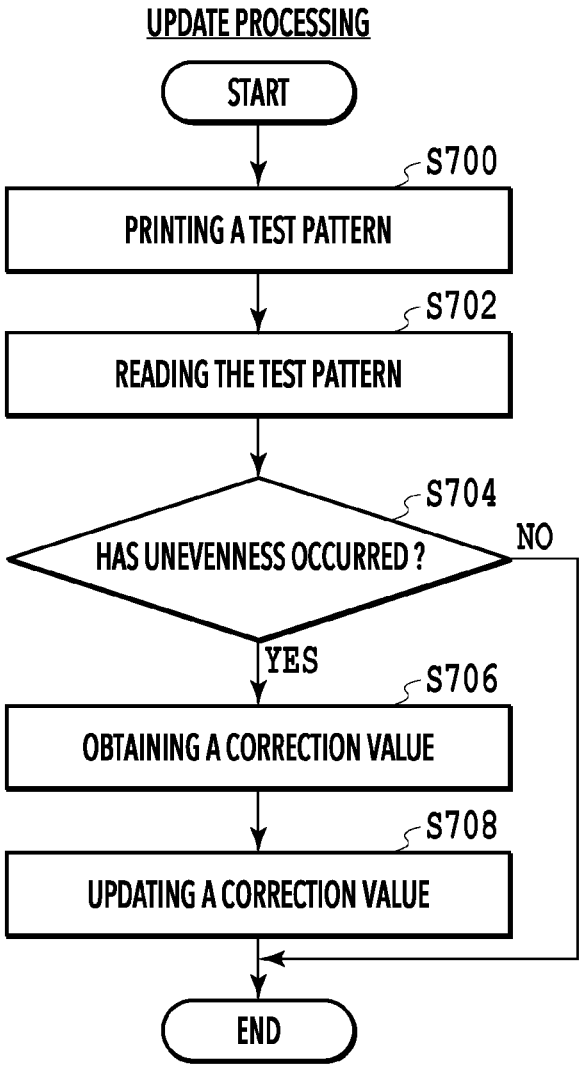
FIG. 7 is a flowchart illustrating a detailed processing routine of update processing.

FIG. 7 is a flowchart illustrating the details of the update processing. In a case where the update processing is started, the test pattern is printed on the print medium P (S700). Thereafter, the test pattern printed on the print medium P is read by the image-capturing unit 52*b* (S702). Next, the read image information is output to the main controller unit 17*a* via the image-capturing controller 80. Then, the processing unit 54 analyzes the read image information and determines whether density unevenness has occurred or not (S704). In a case where density unevenness has occurred in the image information of the read test pattern, it is indicated that the ejection amount has changed in some of the nozzles of the print heads 26. Factors that cause such change in the ejection amount include manufacturing tolerance, change in an ejection opening diameter due to frequency of use, and change in the environment such as temperature and humidity. As described above, in the present embodiment, the image-capturing unit 52*b* and the processing unit 54 function as a detecting unit that detects the ejection state of ink from each nozzle.

In a case where it is determined in S704 that density unevenness has not occurred, the update processing ends. Further, in a case where it is determined in S704 that density unevenness has occurred, a correction value corresponding to the nozzle that ejects ink onto the portion determined to have density unevenness is obtained (S706). That is, the processing unit 54 obtains a correction value for such correction that the nozzle that ejects ink onto the portion determined to have density unevenness ejects ink of the same density as that of the other nozzles.

Figure 8:
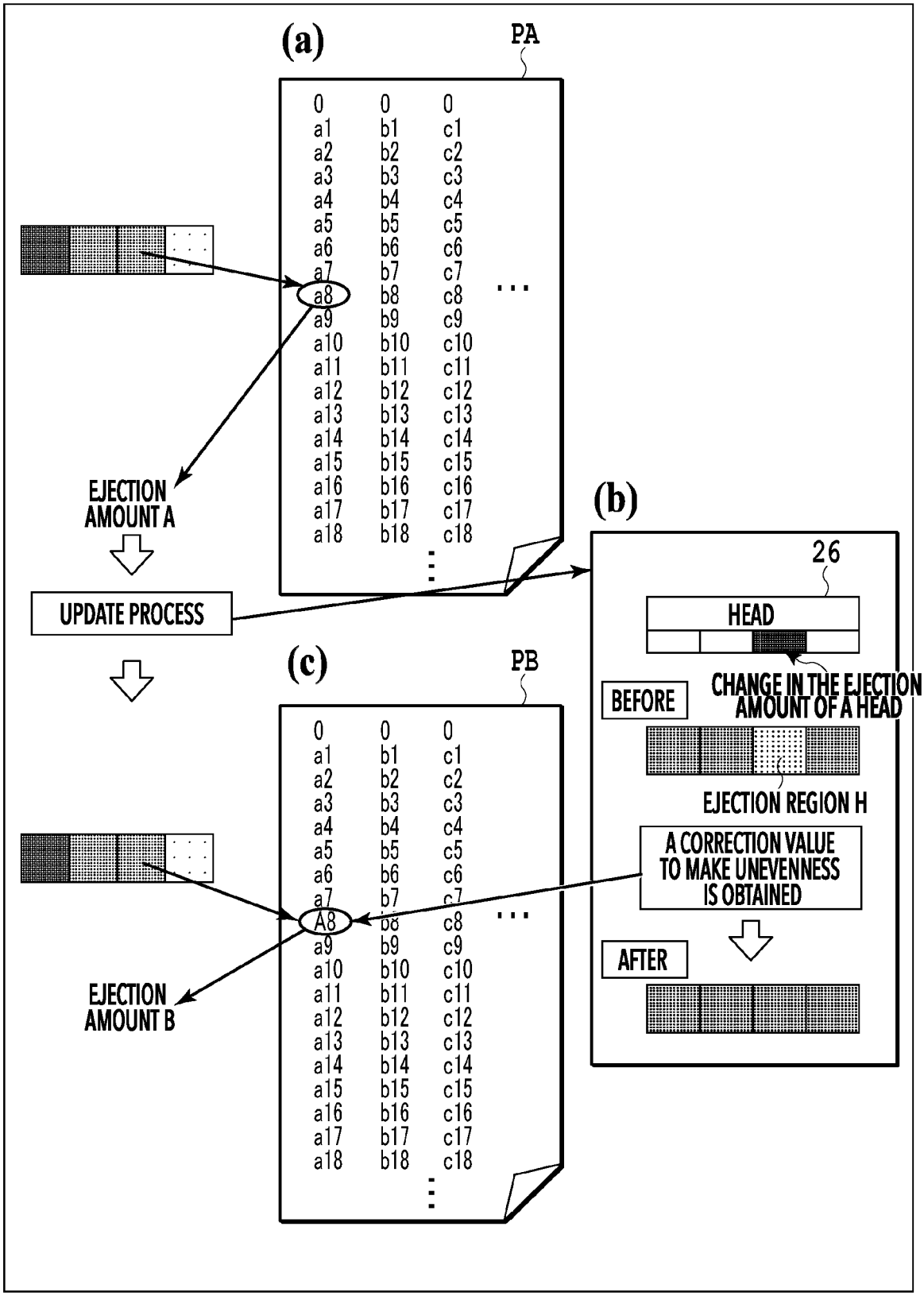
FIG. 8 is diagram for specifically explaining the update processing.

Specifically, for example, it is assumed that density unevenness has occurred in the ejection region H (see portion (b) of FIG. 8) according to the image information of the read test pattern. In this case, a correction value for changing the ejection level of ink (increasing or decreasing the dot number) from the nozzle that ejects ink onto the ejection region H, so that the density of the test pattern is even, is obtained (see portion (c) of FIG. 8).

Thereafter, in the image processing table stored in the storage unit 56, the corresponding correction value (table value) is updated to the correction value obtained in S706 (S708), so that the obtained correction value can be used for image processing. For example, after the update processing, the table value of "a8" is changed to "A8". Therefore, the ejection amount calculated in FIGS. 5A and 5B are changed from EJECTION AMOUNT A to EJECTION AMOUNT B. After S708, the update processing ends. Accordingly, the image processing table is specific to the printing apparatus 10 and is adapted to such change in the usage frequency and usage environment.

As described above, in the present embodiment, the processing unit 54 functions as an updating unit that obtains a correction value (a table value of the image processing table) used in the image processing for an update. Note that the above-described update processing is merely an example, and various publicly-known technologies can be applied to the specific details of processing of calculating and updating the image processing table and the correction value according to the ejection state of ink.

As explained above, the printing apparatus 10 is configured to calculate the consumed amount and the remaining amount of ink, based on binary print data representing ejection and non-ejection of ink. To the image data used for generating the print data, the image processing for correcting the ejection level from a nozzle is performed according to the ejection state of ink in the print head. Furthermore, the maintenance pattern is added to the image data used for generating the print data. The maintenance pattern is a pattern for detecting non-ejection nozzles and for detecting misregistration between colors. In a case where this maintenance pattern is ejected, the ejected pattern is read, so that whether there is any non-ejection nozzle is determined. Then, in a case where there is a non-ejection nozzle, interpolation processing is performed so as to compensate for the non-ejection nozzle by use of the surrounding nozzles. The interpolation processing is performed on the printer engine side. Note that, in a case of performing the interpolation processing in which the surrounding nozzles compensate for a non-ejection nozzle, the total ejection amount becomes different as compared with the case where ejection is actually performed by the non-ejection nozzle. Therefore, by taking information of a non-ejection nozzle, which is detected by use of the maintenance pattern, into consideration for calculating the ejection amount, it is possible to calculate the consumed amount and the remaining amount of ink with more precision.

In commercial printing, the consumed amounts of ink may be compared in a case where print parameters are changed. In this case, in the conventional technologies, it has been necessary for the user to input the parameter value of the print parameter to be compared, so as to calculate the consumed amount and the remaining amount of ink, and, in a case where there are many print parameters to be compared, such a procedure must have been repeatedly executed. On the other hand, the printing apparatus 10 is configured to store multiple combinations having different print parameter values related to the consumed amount of ink in the storage unit 56. Furthermore, in a case of calculating the consumed amount and the remaining amount of ink, the consumed amount and the remaining amount of ink are calculated based on input print parameters and stored print parameters of all combinations.

Therefore, it is possible for the printing apparatus 10 to present the consumed amounts and the remaining amounts of ink based on the multiple combinations of print parameters having different parameter values. Accordingly, the procedure of a job is reduced for the user. In addition, since the consumed amount of ink and the print quality change depending on print parameters, setting of the print parameters requires experience. With the printing apparatus 10, it is possible for the user to check the consumed amounts of ink based on the print quality according to the difference in the parameter values and to determine print parameters in consideration of the cost and the print quality, based on the presented information.

Furthermore, the printing apparatus 10 calculates the consumed amount of ink according to the ejection states of ink from the print heads 26 by use of the control unit 17 mounted in the printing apparatus 10, not the higher-level device HC2 or the host device HC1, which corresponds to an external device of the printing apparatus 10. Note that, for calculating the consumed amount of ink, highly confidential information, such as a table used in image processing and the table values thereof, is required. Therefore, with the printing apparatus 10, it is not necessary to output such highly confidential information, such as the information for calculating the consumed amount of ink including the table used in the image processing and the table values thereof, to the outside.

Furthermore, in the simulation mode in which the consumed amount and the remaining amount of ink are calculated without performing printing, the printing apparatus 10 calculates the consumed amount and the remaining amount of ink by the same processing as in the print mode in which printing is actually performed. Therefore, in the printing apparatus 10, there is no difference between the two modes in terms of the calculated consumed amounts and the remaining amounts of ink.

Other Embodiments

Note that the above-described embodiment may be modified as shown in the following (1) through (7).

(1) Although the printing unit 18 is configured to have multiple print heads 26 in the above-described embodiment, it is also possible that the printing unit 18 is configured to have only one print head 26. Furthermore, although the printing apparatus 10 performs printing by ejecting ink from the print heads 26 onto a conveyed print medium in the above-described embodiment, the present embodiment is not limited as such. That is, there may be such a configuration in which printing is preformed by ejecting ink from a print head that moves in a predetermined direction onto a print medium placed at a predetermined position. Furthermore, although each of the print heads 26 is a full line head in which an array of nozzles that eject ink is arranged over a range corresponding to the entire width of the print medium in the above-described embodiment, it is also possible that each of the print heads 26 is a serial scan head that ejects ink while scanning in a direction intersecting the conveyance direction of the print medium.

(2) Although the conveyance unit 16 is configured to convey the print medium P and the printed product P' by use of the conveyance cylinder 42 and the conveyance mechanism 46 in the above-described embodiment, the present embodiment is not limited as such. That is, it is also possible that the print medium P and the printed product P' are nipped by a pair of rollers for conveyance, and various publicly-known technologies can be applied to the conveyance method. In a case where a pair of rollers is used, the print medium P may be a roll sheet, so that, after transfer, the roll sheet is cut so as to produce a printed product P'. Furthermore, although the printing apparatus 10 is configured to perform printing by transfer in the above-described embodiment, the present embodiment is not limited as such, and there may be such a configuration in which ink is directly ejected from a print head to a print medium.

(3) Although the image processing is performed by the control unit 17 (control device) mounted in the printing apparatus 10 in the above-described embodiment, the present embodiment is not limited as such. That is, it is also possible that the image processing is executed by an external device such as the higher-level device HC2. Furthermore, although the control unit 17 calculates the consumed amount of ink in the above-described embodiment, the present embodiment is not limited as such. That is, it is possible that a control device (which may be the higher-level device HC2), which functions as an external device capable of inputting and outputting various kinds of information, is connected to the printing apparatus 10 via a communication unit (for example, the communication I/F 62, etc.), so that the external control device calculates the consumed amount of ink. In these cases, highly confidential data such as information for calculating the consumed amount of ink including the image processing table is encrypted and sent to the external device.

(4) Although the calculated consumed amount of ink includes the consumed amount of ink for the maintenance pattern in the above-described embodiment, the present embodiment is not limited as such. That is, it is also possible that the calculated consumed amount of ink includes the consumed amounts of ink for various processes executed at specific timings for the purpose of maintaining and recovering the ejection state of ink, such as pre-ejection and wiping processes. Furthermore, although the transfer body 12 is mounted on the outer peripheral surface of the transfer cylinder 34 in the above-described embodiment, the present embodiment is not limited as such. That is, it is possible to apply various kinds of publicly-known technologies, such as a system in which the transfer body 12, which is formed as an endless belt, is made to cyclically run.

(5) Although, as illustrated in FIG. 6, the file capable of displaying the consumed amounts and the remaining amounts of ink in a comparable manner, based on print parameters related to the consumed amounts of ink, is used as the file capable of notifying of the calculated consumed amounts and remaining amounts of ink in the above-described embodiment, the present embodiment is not limited as such. That is, it is also possible that the calculated consumed amount and remaining amount of ink are notified by a publicly-known notification method such as audio guidance or by both displaying a file and audio guidance, based on print parameters.

(6) Although the maintenance pattern is added after the image processing is executed in the above-described embodiment, the present embodiment is not limited as such. That is, it is also possible that the image processing is executed after the maintenance pattern is added to the image data. In this case, the image processing is performed on the maintenance pattern as well.

(7) The above-described embodiment and various forms shown in (1) through (6) may be combined as appropriate.

Embodiment(s) of the present invention can also be realized by a computer of a system or apparatus that reads out and executes computer executable instructions (e.g., one or more programs) recorded on a storage medium (which may also be referred to more fully as a 'non-transitory computer-readable storage medium') to perform the functions of one or more of the above-described embodiment(s) and/or that includes one or more circuits (e.g., application specific integrated circuit (ASIC)) for performing the functions of one or more of the above-described embodiment(s), and by a method performed by the computer of the system or apparatus by, for example, reading out and executing the computer executable instructions from the storage medium to perform the functions of one or more of the above-described embodiment(s) and/or controlling the one or more circuits to perform the functions of one or more of the above-described embodiment(s). The computer may comprise one or more processors (e.g., central processing unit (CPU), micro processing unit (MPU)) and may include a network of separate computers or separate processors to read out and execute the computer executable instructions. The computer executable instructions may be provided to the computer, for example, from a network or the storage medium. The storage medium may include, for example, one or more of a hard disk, a random-access memory (RAM), a read only memory (ROM), a storage of distributed computing systems, an optical disk (such as a compact disc (CD), digital versatile disc (DVD), or Blu-ray Disc (BD)™), a flash memory device, a memory card, and the like.

While the present invention has been described with reference to exemplary embodiments, it is to be understood that the invention is not limited to the disclosed exemplary embodiments. The scope of the following claims is to be accorded the broadest interpretation so as to encompass all such modifications and equivalent structures and functions.

This application claims the benefit of Japanese Patent Application No. 2019-147685, filed Aug. 9, 2019, which is hereby incorporated by reference herein in its entirety.

What is claimed is:

1. A control device comprising:

a correcting unit configured to perform, in a case where an ejection amount of a predetermined nozzle for printing a test pattern is a first ejection amount, correction processing for correcting a value relating to the predetermined nozzle so that the ejection amount of the predetermined nozzle for printing the test pattern becomes a second ejection amount a determining unit configured to determine whether there is any non-ejection nozzle in a first printing different from the printing of the test pattern;

a controlling unit configured to perform control processing so that ink to be ejected from the non-ejection nozzle is ejected from a nozzle surrounding the non-ejection nozzle in a second printing after the first printing and the printing of the test pattern; and a calculating unit configured to calculate a consumed amount of ink for the second printing based on (1) print data for the second printing, (2) a parameter indicating a condition of printing, (3) a result of the correction processing, and (4) a result of the control processing.

2. The control device according to claim 1, wherein the calculating unit further calculates a remaining amount of ink, based on the consumed amount.

3. The control device according to claim 2, further comprising:

a detecting unit configured to detect a state of a print head; and a updating unit configured to update a reference value to be used in image processing, based on a detection result from the detecting unit.

4. The control device according to claim 3, further comprising a generating unit configured to generate print data, wherein the generating unit adds a pattern for detecting the state of the print head to image data to which the image processing has been performed, so as to generate the print data.

5. The control device according to claim 2, wherein the calculating unit further calculates the consumed amount and the remaining amount by changing values of the parameter, which is related to the consumed amount of ink.

6. The control device according to claim 5, wherein a file capable of providing notification of the consumed amount and the remaining amount according to the parameter is created.

7. The control device according to claim 6, wherein the file is displayed in such a manner that the consumed amount and the remaining amount are comparable, based on the parameter related to the consumed amount of ink.

8. The control device according to claim 2, further comprising a selecting unit configured to be capable of selecting a first mode and a second mode, wherein, in a case where the first mode is selected, the calculating unit calculates the consumed amount and the remaining amount, and printing on a print medium is executed, and wherein, in a case where the second mode is selected, the calculating unit calculates the consumed amount and the remaining amount, and a file capable of providing notification of the consumed amount and the remaining amount according to the parameter is created.

9. The control device according to claim 8, wherein, in the first mode, a stored remaining amount of ink is updated to the remaining amount calculated by the calculating unit.

10. The control device according to claim 1, further comprising a communication unit configured to be capable of communicating with an external device that is capable of inputting and outputting information, wherein information for calculating the consumed amount of ink is not output to the external device via the communication unit.

11. The control device according to claim 1, further comprising a print head.

12. The control device according to claim 1, wherein the first printing includes printing of a maintenance pattern, and wherein in the printing of the maintenance pattern, it is determined whether the non-ejection nozzle exists.

13. The control device according to claim 1, wherein the second printing includes printing of a maintenance pattern, and wherein the calculated consumed amount of ink includes a consumed amount of ink for the printing of the maintenance pattern.

14. The control device according to claim 1, wherein the control processing is processing for generating a dot pattern such that it is controlled so that ink to be ejected from the non-ejection nozzle is ejected from a nozzle surrounding the non-ejection nozzle, and wherein the print data for the second printing includes the dot pattern.

15. The control device according to claim 1, further comprising a printing unit configured to perform the second printing based on the print data for the second printing.

16. The control device according to claim 1, wherein the first printing and the second printing are based on a print job input from a device external to the control device.

17. A control method of a control device, the control method comprising:

in a case where an ejection amount of a predetermined nozzle for printing a test pattern is a first ejection amount, correcting a value relating to the predetermined nozzle so that the ejection amount of the predetermined nozzle for printing the test pattern becomes a second ejection amount;

determining whether there is any non-ejection nozzle in a first printing different from the printing of the test pattern;

performing control so that ink to be ejected from the non-ejection nozzle is ejected from a nozzle surrounding the non-ejection nozzle in a second printing after the first printing and the printing of the test pattern; and calculating a consumed amount of ink for the second printing based on (1) print data for the second printing, (2) a parameter indicating a condition of printing, (3) a result of the correcting, and (4) a result of the performing control.

18. A non-transitory computer-readable storage medium storing a program for causing a computer to function as a control device, the control device comprising:

a correcting unit configured to perform, in a case where an ejection amount of a predetermined nozzle for printing a test pattern is a first ejection amount, correction processing for correcting a value relating to the predetermined nozzle so that the ejection amount of the predetermined nozzle for printing the test pattern becomes a second ejection amount;

a determining unit configured to determine whether there is any non-ejection nozzle in a first printing different from the printing of the test pattern;

a controlling unit configured to perform control processing so that ink to be ejected from the non-ejection nozzle is ejected from a nozzle surrounding the non-ejection nozzle in a second printing after the first printing and the printing of the test pattern; and a calculating unit configured to calculate a consumed amount of ink for the second printing based on (1) print data for the second printing, (2) a parameter indicating a condition of printing, (3) a result of the correction processing, and (4) a result of the control processing.

* * * * *